US007278875B2

(12) United States Patent
Sakamoto

(10) Patent No.: US 7,278,875 B2
(45) Date of Patent: Oct. 9, 2007

(54) PRESS-CONTACTING TERMINAL

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/318,468

(22) Filed: Dec. 28, 2005

(65) Prior Publication Data

US 2006/0148303 A1 Jul. 6, 2006

(30) Foreign Application Priority Data

Dec. 28, 2004 (JP) ..... P2004-379115

(51) Int. Cl.
*H01R 11/20* (2006.01)

(52) U.S. Cl. ..... 439/397

(58) Field of Classification Search ..... 439/379, 439/393, 395, 397, 398, 406
See application file for complete search history.

(56) References Cited

U.S. PATENT DOCUMENTS

| | | | | |
|---|---|---|---|---|
| 5,133,672 A | * | 7/1992 | Nelligan et al. | 439/399 |
| 5,139,434 A | | 8/1992 | Goodman | |
| 5,554,046 A | * | 9/1996 | Sugiyama et al. | 439/397 |

FOREIGN PATENT DOCUMENTS

| | | | |
|---|---|---|---|
| GB | 2004425 | A | 3/1979 |
| JP | 06-203888 | A | 7/1994 |
| JP | 06-333613 | A | 12/1994 |
| JP | 10149847 | A | 6/1998 |
| JP | 11-040214 | A | 2/1999 |
| JP | 2000260496 | A | 9/2000 |
| JP | 2003-217700 | A | 7/2003 |
| JP | 2003-346961 | A | 12/2003 |

* cited by examiner

*Primary Examiner*—Truc Nguyen
(74) *Attorney, Agent, or Firm*—Sughrue Mion, PLLC

(57) ABSTRACT

A press-contacting terminal includes a terminal connection portion for electrical connecting to a mating terminal, and a wire connection portion that is extended from the terminal connection portion in a first direction. The wire connection portion includes a base plate portion, first and second side plate portions that are provided on opposite side edges of the base plate portion in a second direction perpendicular to the first direction, a press-contacting portion for press-contacting a sheathed wire, the press-contacting portion being disposed on the base plate in perpendicular to both of the base plate portion and the side plate portions, and an interconnecting portion that connects the press-contacting portion to the first side plate portion. The first and second side plate portions have a height so as not to interfere with the sheathed wire to be press-contacted with the press-contacting portion.

4 Claims, 3 Drawing Sheets

PRESS-CONTACTING TERMINAL

BACKGROUND OF THE INVENTION

This invention relates to a press-contacting terminal.

FIGS. 4 and 5 show known related press-contacting terminals (see, for example, JP-A-2003-217700 (Pages 2 and 4 to 5, FIGS. 4 and 15)).

The press-contacting terminal 1, shown in FIG. 4, is formed by stamping and bending a single electrically-conductive metal sheet. This press-contacting terminal 1 includes a terminal connection portion 2 of a generally rectangular tubular shape into which a mating terminal can be inserted to be electrically connected thereto, and a wire connection portion 3 extending from the terminal connection portion 2 in a direction of connecting of the mating terminal to the terminal 1.

The wire connection portion 3 includes a base plate portion 4, a pair of side plate portions 5 formed on and projecting perpendicularly respectively from widthwise-opposite side edges of the base plate portion 4, and press-contacting portions 6 for cutting an insulating sheath of a sheathed wire to be brought into contact with an internal conductor of the sheathed wire. Each press-contacting portion 6 includes a pair of press-contacting blades 8 which are formed by stamping predetermined opposed portions of the pair of side plate portions 5 and then by bending these stamped-out portions inwardly. A slot 9 is formed between the pair of press-contacting blades 8. The two press-contacting blade portions 6 are arranged in the mating terminal-connecting direction.

The sheathed wire is press-fitted into a space between the pair of side plate portions 5 from the upper side, and the insulating sheath of the sheathed wire is cut by upper end portions of the press-contacting blades 8, and then the internal conductor of the sheathed wire is inserted into the slots 9, so that the sheathed wire is press-contacted with the press-contacting portions 6, and therefore is electrically connected to the press-contacting terminal 1.

Like the above-mentioned press-contacting terminal 1, the press-contacting terminal 11 of FIG. 11 is formed by stamping and bending a single electrically-conductive metal sheet. This press-contacting terminal 11 includes a terminal connection portion 12 of a generally rectangular tubular shape into which a mating terminal can be inserted to be electrically connected thereto, and a wire connection portion 13 extending from the terminal connection portion 12 in a direction of connecting of the mating terminal to the terminal 11.

Two press-contacting piece portions 17*a* and 17*b*, each having a pair of press-contacting blades 18 cooperating with each other to define a slot 19 therebetween, are formed on the wire connection portion 13, and are arranged in the mating terminal-connecting direction. The terminal connection portion 12 is formed on a front side portion of the press-contacting terminal 11, and the rear press-contacting piece portion 17*a* is formed by bending a distal end portion of a base plate portion 14, extending from a base plate portion of the terminal connection portion 12, at a right angle. A strip-like portion 15 extends from a top plate portion of the terminal connection portion 12, and is bent to be superposed on the base plate portion 14 in a direction of the height, and the front press-contacting piece 17*b* is formed by bending a distal end portion of the strip-like portion 15 at a right angle.

A sheathed wire is pressed down from the upper side of the press-contacting blades 17*a* and 17*b*, and an insulating sheath of the sheathed wire is cut by upper end portions of the press-contacting blades 18, and then an internal conductor of the sheathed wire is inserted into the slots 19, so that the sheathed wire is press-contacted with the press-contacting piece portions 17*a* and 17*b*, and therefore is electrically connected to the press-contacting terminal 11.

The above-mentioned press-contacting terminals 1 and 11 are mounted within a connector housing of a connector, and with an increasing demand for a compact design of recent connectors, it has now been required to achieve a low-height design of the press-contacting terminals (that is, the reduction of the size of the press-contacting terminals in the direction of their height) and a narrow-pitch arrangement of the terminals (that is, the reduction of the size of the presscontacting terminals in the direction of their width). However, the related press-contacting terminals, shown in FIGS. 4 and 5, have the following problems which are to be solved in order to meet the above requirements.

In the press-contacting terminal 1 of FIG. 4, the pair of press-contacting blades 8 of each press-contacting portion 6 are formed by bending the stamped-out portions of the pair of side plate portions 5, and are disposed between the pair of side plate portions 5. The sheathed wire to be press-contacted with the terminal is press-fitted into the space between the pair of side plate portions 5. Therefore, the width of the press-contacting terminal 1 is at least the sum of the width of the sheathed wire and the thicknesses of the pair of side plate portions 5 (that is, a thickness twice larger than the thickness of the metal sheet forming the press-contacting terminal 1). Therefore, the reduction of the press-contacting terminal 1 in the direction of the width thereof is limited, and this is disadvantageous with respect to the achievement of the narrow-pitch arrangement.

On the other hand, in the press-contacting terminal 11 of FIG. 5, the front press-contacting piece portion 17*b* is formed by bending the distal end portion of the strip-like portion 15 (superposed on the base plate portion 14 in the direction of the height) at a right angle. Therefore, the thickness of the strip-like portion 15 (that is, the thickness of the metal sheet forming the press-contacting terminal 11) is interposed between the press-contacting piece portion 17*b* and the base plate portion 14 in the direction of the height. This is disadvantageous with respect to the reduction of the press-contacting terminal 11 in the direction of the height. And besides, the wire connection portion 13 of the press-contacting terminal 11 has a flat plate-like shape, and therefore there is a fear that its strength is reduced.

SUMMARY OF THE INVENTION

This invention has been made in view of the above problems, and an object of the invention is to provide a press-contacting terminal in which the size of the press-contacting terminal can be reduced both in directions of its height and width so as to contribute to a compact design of a connector, and also a sufficient strength of the press-contacting terminal can be secured.

The above object has been achieved by a press-contacting terminal of the present invention including a terminal connection portion for electrical connection to a mating terminal, and a wire connection portion extending from the terminal connection portion in a direction of connecting of the mating terminal to the press-contacting terminal; characterized in that the wire connection portion includes a base plate portion, a pair of side plate portions formed in an upstanding manner respectively on opposite side edges of the base plate portion extending along the mating terminal-connecting direction, and a press-contacting piece portion with which a sheathed wire can be press-contacted; and the press-contacting piece portion is connected to one of the pair of side plate portions via a bent interconnecting portion, and is disposed on the base plate portion in perpendicularly intersecting relation to the side plate portions and the base plate portion; and the pair of side plate portions have such a height as not to interfere with the sheathed wire press-contacted with the press-contacting piece portion.

Preferably, the press-contacting piece portion, connected to the one side plate portion via the interconnecting portion, is retainingly engaged in an engagement groove formed in the other side plate portion.

In the present invention, the press-contacting piece portion (with which the sheathed wire is to be press-contacted) is connected via the bent interconnecting portion to one of the pair of side plate portions formed in an upstanding manner respectively on the opposite side edges of the base plate portion, and is disposed on the base plate portion in perpendicularly intersecting relation to the side plate portions and the base plate portion. Namely, the press-contacting piece portion is integrally connected to the side plate portion, and the interconnecting portion, interconnecting the press-contacting piece portion and the side plate portion, is bent, and with this construction the press-contacting piece portion can be disposed directly on the base plate portion, and therefore the size of the press-contacting terminal in the direction of its height can be reduced.

And besides, the pair of side plate portions have such a height as not to interfere with the sheathed wire press-contacted with the press-contacting piece portion. Namely, the sheathed wire will not be received in a space between the pair of side plate portions, and instead the pair of side plate portions can be disposed between the sheathed wire, press-contacted with the press-contacting piece portion, and the base plate portion, and therefore the size of the press-contacting terminal in the direction of its width can be reduced.

Thus, the size of the press-contacting terminal can be reduced both in the directions of its height and width so as to contribute to a compact design of a connector.

Furthermore, the pair of side plate portions are formed in an upstanding manner on the opposite side edges of the base plate portion, respectively. Namely, the base plate portion, including the pair of side plate is portions, has a generally U-shaped cross-section, and the strength of the base plate portion can be enhanced as compared with a flat plate-like base plate portion.

Furthermore, the press-contacting piece portion, connected to one of the two side plate portions via the interconnecting portion, is retainingly engaged in the engagement groove formed in the other side plate portion, so that the press-contacting piece portion is supported at its opposite sides by the pair of side plate portions. As a result, the strength of the press-contacting piece portion is enhanced.

According to the present invention, there is also provided a press-contacting terminal, comprising:

a terminal connection portion for electrical connecting to a mating terminal; and a wire connection portion that is extended from the terminal connection portion in a first direction, wherein the wire connection portion includes:

a base plate portion;

first and second side plate portions that are provided on opposite side edges of the base plate portion in a second direction perpendicular to the first direction;

a press-contacting portion for press-contacting a sheathed wire, the press-contacting portion being disposed on the base plate; and an interconnecting portion that connects the press-contacting portion to the first side plate portion;

wherein the first and second side plate portions have a height so as not to interfere with the sheathed wire to be press-contacted with the press-contacting portion.

Preferably, the press-contacting portion has a slot for press-contacting the sheathed wire. Height of the first and second side plate portions is smaller than a length from the base plate portion to a lower portion of the slot.

Preferably, the second side plate portion has a groove. The press-contacting portion is engaged in the groove.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of a press-contacting terminal of the present invention will now be described with reference to the drawings.

Figure 1:
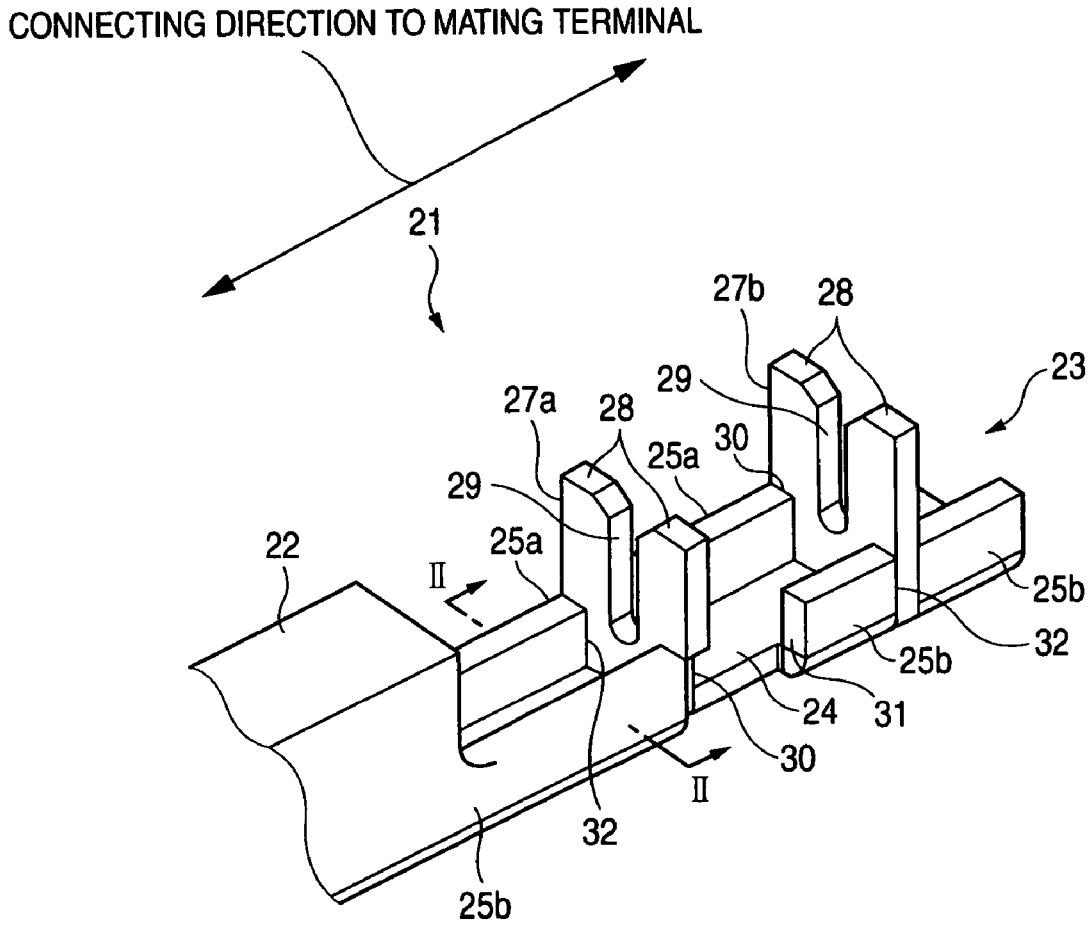
FIG. 1 is a perspective view of an important portion of one preferred embodiment of a press-contacting terminal of the present invention.
Figure 2:
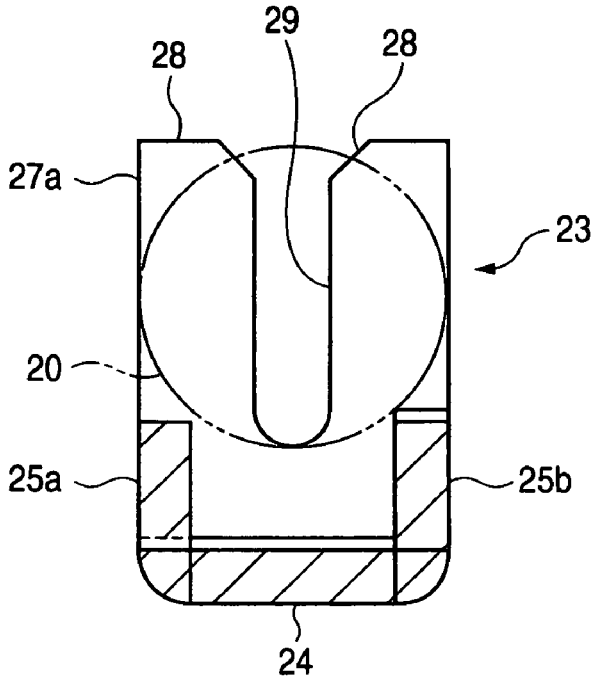
FIG. 2 is a cross-sectional view taken along the line II-II of FIG. 1.
Figure 3:
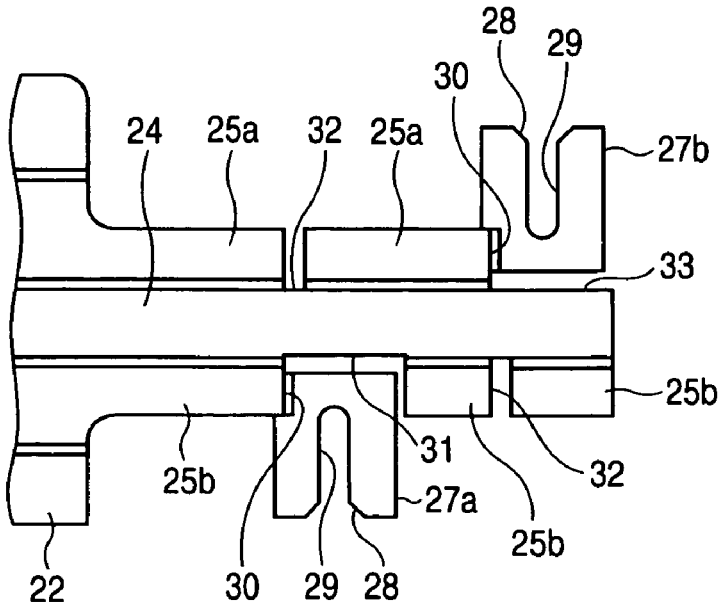
FIG. 3 is a developed view of the press-contacting terminal of FIG. 1.
Figure 4:
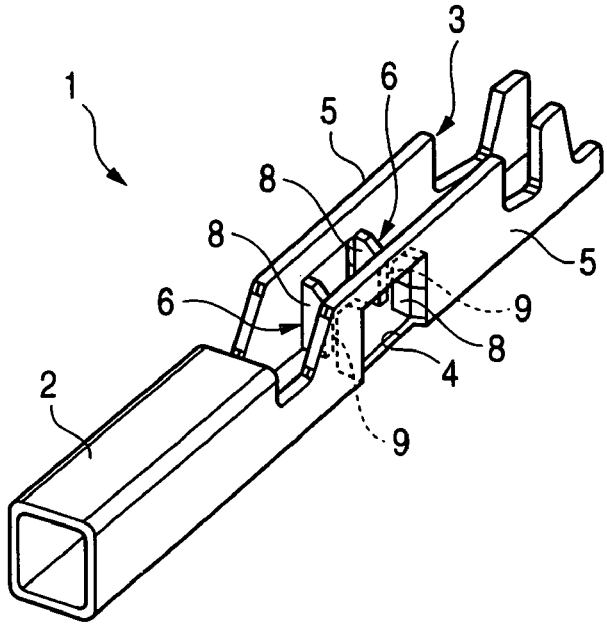
FIG. 4 Prior Art
FIG. 4 is a perspective view of a related press-contacting terminal.
Figure 5:
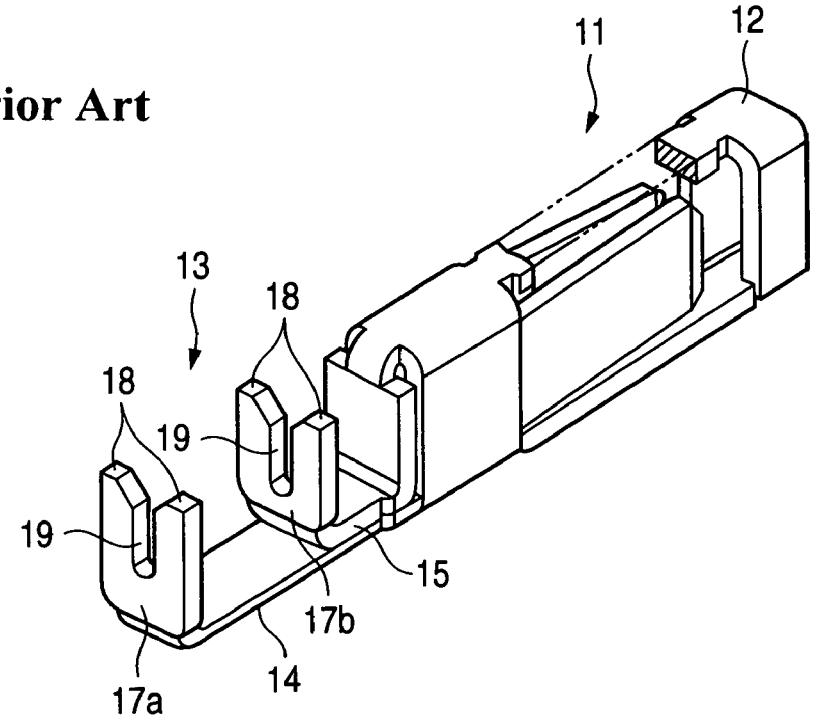
FIG. 5 Prior Art
FIG. 5 is a perspective view of another related press-contacting terminal.

FIG. 1 is a perspective view of an important portion of one preferred embodiment of the press-contacting terminal of the invention, FIG. 2 is a is cross-sectional view taken along the line II-II of FIG. 1, and FIG. 3 is a developed view of the press-contacting terminal of FIG. 1.

The preferred embodiment of the press-contacting terminal 21 of the invention is formed by stamping and bending a single electrically-conductive metal sheet. This press-contacting terminal 21 includes a terminal connection portion 22 of a rectangular tubular shape into which a mating terminal (not shown) can be inserted to be electrically connected thereto, and a wire connection portion 23 extending from the terminal connection portion 22 in a direction of connecting of the mating terminal to the terminal 21. The wire connection portion 23 includes a base plate portion 24 extending from one side of a rear end edge of the terminal connection portion 22 in the mating terminal-connecting direction, a pair of upstanding side plate portions 25*a* and 25*b* formed on and projecting perpendicularly respectively from opposite side edges (spaced from each other in a direction of a width of the base plate portion 24) of the base plate portion 24, and press-contacting piece portions 27*a* and 27*b* with which a sheathed wire 20 can be press-contacted. The press-contacting piece portions 27*a* and 27*b* are arranged in the mating terminal-connecting direction. In the following description, for convenience' sake, that side where the terminal connection portion 22 is provided is defined as "the front side of the press-contacting terminal 21", and that side where the wire connection portion 23 is provided is defined as "the rear side of the press-contacting terminal 21", and that side where the base plate portion 24 is provided is defined as "the lower side of the press-contacting terminal 21", and that side toward which the side plate portions 25*a* and 26*b* extend from the base plate portion 24 is defined as "the upper side of the press-contacting is terminal 21". The left and right sides of the press-contacting terminal 21 are so defined when it is viewed from its front side, with its upper and lower sides defined as described above.

Each of the press-contacting piece portions 27*a* and 27*b* has a generally tuning fork-like shape as a whole, and has a pair of press-contacting blades 28 extending upwardly in spaced relation to each other, and a blade is formed at an upper end portion of each press-contacting blade 28. An upwardly-open slot 29 is formed between the pair of press-contacting blades 28. The front press-contacting piece portion 27*a* is connected at a lower portion of its right side edge to the right side plate portion 25*b* via a bent interconnecting portion 30, and is disposed on the base plate portion 24 in perpendicularly intersecting relation to the two side plate portions 25*a* and 25*b* and the base plate portion 24. A lower portion of the left side edge portion of the front press-contacting piece portion 27*a* is snugly fitted in an engagement groove 32 formed in the left side plate portion 25*a*, and therefore is retainingly engaged in this engagement groove 32. The rear press-contacting piece portion 27*b* is connected at a lower portion of its left side edge to the left side plate portion 25*a* via a bent interconnecting portion 30, and is disposed on the base plate portion 24 in perpendicularly intersecting relation to the two side plate portions 25*a* and 25*b* and the base plate portion 24. A lower portion of the right side edge portion of the rear press-contacting piece portion 27*b* is snugly fitted in an engagement groove 32 formed in the right side plate portion 25*b*, and therefore is retainingly engaged in this engagement groove 32.

FIG. 3 shows a condition before the metal sheet for forming the press-contacting terminal 21 is subjected to a bending operation. The side plate portions 25*a* and 25*b* are formed respectively at the widthwise-opposite side edges of the base plate portion 24. A notch 31 of a generally rectangular shape is formed in an intermediate portion (in the front-rear direction) of the right side plate portion 25*b*, and the press-contacting piece portion 27*a* is disposed in this notch 31, and is connected to the right side plate portion 25*b* via the interconnecting portion 30, and is separated from the base plate portion 24. The engagement portion 32 for snugly receiving the lower portion of the left side edge portion of the press-contacting piece portion 27*a* is formed in that portion of the left side plate portion 25*a* which is disposed generally in registry with the interconnecting portion 30 (interconnecting the right side plate portion 25*b* and the press-contacting piece portion 27*a*), with the base plate portion 24 interposed therebetween.

A notch 33 of a generally rectangular shape is formed in a rear end portion of the left side plate portion 25*a*, and the press-contacting piece portion 27*b* is disposed in this notch 33, and is connected to the left side plate portion 25*a* via the interconnecting portion 30, and is separated from the base plate portion 24. The engagement portion 32 for snugly receiving the lower portion of the right side edge portion of the press-contacting piece portion 27*b* is formed in that portion of the right side plate portion 25*b* which is disposed generally in registry with the interconnecting portion 30 (interconnecting the left side plate portion 25*a* and the press-contacting piece portion 27*b*), with the base plate portion 24 interposed therebetween.

For forming the press-contacting terminal 21 from its developed condition shown in FIG. 3, first, each interconnecting portion 30 is bent at a right angle, thereby bringing the press-contacting piece portion 27*a*, 27*b* into perpendicularly upstanding relation to the side plate portion 25*b*, 25*a*. Then, a connecting portion between the side plate portion 25*a* and the base plate portion 24, as well as a connecting portion between the side plate portion 26*b* and the base plate portion 24, is bent, thereby bringing the side plate portions 25*a* and 25*b* into perpendicularly upstanding relation to the base plate portion 24. As a result, the press-contacting piece portion 27*a* is disposed on the base plate portion 24 in perpendicularly intersecting relation to the opposite side plate portions 25*a* and 25*b* and the base plate portion 24 in such a manner that the lower portion of the left side edge portion of the press-contacting piece portion 27*a* is snugly fitted in the engagement groove 32 (formed in the left side plate portion 25*a*) to be retainingly engaged therein. Also, the press-contacting piece portion 27*b* is disposed on the base plate portion 24 in perpendicularly intersecting relation to the opposite side plate portions 25*a* and 25*b* and the base plate portion 24 in such a manner that the lower portion of the right side edge portion of the press-contacting piece portion 27*b* is snugly fitted in the engagement groove 32 (formed in the right side plate portion 25*b*) to be retainingly engaged therein.

For press-contacting the sheathed wire 20 with the press-contacting terminal 21 of this construction, the sheathed wire 20 is pressed down from the upper side of the press-contacting piece portions 27*a* and 27*b*, and an insulating sheath of the sheathed wire 20 is cut by the upper end portions of the press-contacting blades 28, and an internal conductor of the sheathed wire 20 is inserted into the slots 29. As a result, the sheathed wire 20 is press-contacted with the press-contacting piece portions 27*a* and 27*b*, and therefore is electrically connected to the press-contacting terminal 21.

Here, as shown in FIG. 2, the pair of side plate portions 25*a* and 25*b* have such a height as not to interfere with the sheathed wire 20 press-contacted with the press-contacting piece portions 27*a* and 27*b* (that is, have such a height that the upper ends of the side plate portions 25*a* and 25*b* will not contact or will slightly contact with the sheathed wire 20).

In the press-contacting terminal 21 of this embodiment, each press-contacting piece portion 27 (with which the sheathed wire 20 is to be press-contacted) is connected via the bent interconnecting portion 30 to one of the pair of side plate portions 25 formed in an upstanding manner respectively on the opposite side edges of the base plate portion 24, and is disposed on the base plate portion 24 in perpendicularly intersecting relation to the opposite side plate portions 25 and the base plate portion 24. Namely, each press-contacting piece portion 27 is integrally connected to the corresponding side plate portion 25, and the interconnecting portion 30, interconnecting the press-contacting piece portion 27 and the side plate portion 25, is bent, and by doing so, the press-contacting piece portion 27 can be disposed directly on the base plate portion 24, and therefore the size of the press-contacting terminal 21 in the direction of its height can be reduced.

And besides, the pair of side plate portions 25 have such a height as not to interfere with the sheathed wire 20 press-contacted with the press-contacting piece portions 27. Namely, the sheathed wire 20 will not be received in the space between the pair of side plate portions 25, and instead the pair of side plate portions 25 can be disposed between the sheathed wire 20, press-contacted with the press-contacting piece portions 27, and the base plate portion 24, and therefore the size of the press-contacting terminal 21 in the direction of its width can be reduced.

Thus, the size of the press-contacting terminal 21 can be reduced both in the directions of its height and width so as to contribute to a compact design of a connector.

Furthermore, the pair of side plate portions 25 are formed in an upstanding manner on the opposite side edges of the base plate portion 24, respectively. Namely, the base plate portion 24, including the pair of side plate portions 25, has a generally U-shaped cross-section, and the strength of the base plate portion 24 can be enhanced as compared with a flat plate-like base plate portion.

Furthermore, each press-contacting piece portion 27, connected to one of the two side plate portions 25 via the interconnecting portion 30, is retainingly engaged in the engagement groove 32 formed in the other side plate portion 25, so that the press-contacting piece portion 27 is supported at its opposite sides by the pair of side plate portions 25. As a result, the strength of the press-contacting piece portion 27 is enhanced.

The present invention is not limited to the above embodiment, and suitable modifications can be made without departing from the subject matter of the invention.

For example, in the above embodiment, although the two press-contacting piece portions 27 are arranged in the mating terminal-connecting direction, three or more press-contacting piece portions 27 can be arranged in this direction.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-379115 filed on Dec. 28, 2004, the contents of which are incorporated herein for reference.

What is claimed is:

1. A press-contacting terminal, comprising:

a terminal connection portion for electrical connecting to a mating terminal; and a wire connection portion that is extended from the terminal connection portion in a first direction, wherein the wire connection portion includes:

a base plate portion;

first and second side plate portions that are provided on opposite side edges of the base plate portion in a second direction perpendicular to the first direction;

a press-contacting portion for press-contacting a sheathed wire, the press-contacting portion being disposed on the base plate;

an interconnecting portion that connects the press-contacting portion to the first side plate portion; and a cut-out portion on the first side plate portion disposed adjacent to said interconnecting portion, wherein the first and second side plate portions have a height so as not to interfere with the sheathed wire to be press-contacted with the press-contacting portion.

2. The press-contacting terminal according to claim 1, wherein the press-contacting portion has a slot for press-contacting the sheathed wire; and wherein height of the first and second side plate portions is smaller than a length from the base plate portion to a lower portion of the slot.

3. The press-contacting terminal according to claim 1, wherein the second side plate portion has a groove; and wherein the press-contacting portion is engaged in the groove.

4. The press-contacting terminal according to claim 1, wherein the press-contacting portion and the first side plate portion are unitary.

* * * * *